United States Patent [19]

Hara et al.

[11] 3,997,128

[45] Dec. 14, 1976

[54] WIRE TAKE UP APPARATUS

[75] Inventors: Ryoichi Hara; Masamichi Yajima, both of Ichihara, Japan

[73] Assignee: The Furukawa Electric Co., Ltd., Tokyo, Japan

[22] Filed: Dec. 10, 1975

[21] Appl. No.: 639,361

[30] Foreign Application Priority Data

| | | |
|---|---|---|
| Apr. 8, 1975 | Japan | 50-41871 |
| Aug. 14, 1975 | Japan | 50-98134 |
| Dec. 18, 1974 | Japan | 49-152540[U] |

[52] U.S. Cl. ..... 242/158.4 R; 242/158 R; 242/158.2

[51] Int. Cl.[2] ..... B65H 54/28

[58] Field of Search ..... 242/158.4 R, 158 R, 242/158 F, 158.2, 158.5, 158.1, 157.1, 158.4 A, 25 R

[56] References Cited

UNITED STATES PATENTS

| | | | |
|---|---|---|---|
| 3,257,087 | 6/1966 | Kriete et al. | 242/158.4 R |
| 3,319,070 | 5/1967 | Schneider | 242/158 R X |
| 3,833,184 | 9/1974 | Hara et al. | 242/158 R |
| 3,951,355 | 4/1976 | Morioka et al. | 242/158.4 R X |

*Primary Examiner*—Stanley N. Gilreath
*Attorney, Agent, or Firm*—Woodling, Krost, Granger & Rust

[57] ABSTRACT

In an apparatus for taking up a relatively thicker wire such as an electric wire or an electric cable on a reel, comprising a distributor for distributing said wire along the axis of said reel, wire raising up detecting means is provided which electrically detects that a first turn of a new winding layer of said wire is being raised up on the reel adjacent to either of the flanges of said reel, so that it produces an electric signal to instruct said distributor to move in a reverse direction. The detecting means is characterized to comprise at least two adjacent arms pivotally mounted on a fixed axis parallel to the axis of said reel to be engaged against the wire wound on said reel; and an angular-electro converter to convert the angle at which said arms are pivotally moved relative to each other into an electric signal having the amplitude proportional to the angle.

11 Claims, 22 Drawing Figures

WIRE TAKE UP APPARATUS

BACKGROUND OF THE INVENTION

Generally, a wire take up apparatus which takes up a relatively thicker wire such as an electric wire or an electric cable on a reel in an arranged manner, comprises a distributor or traverser to distribute the wire along the axis of the reel. When the distributor reaches either of the flanges of the reel, it stops until a new winding layer starts and completes a first turn of the wire, and then it should be reversed in order to take up the subsequent turns of wire. Detector means which electrically detects raising up of the wire which is caused by a new winding layer starting on the old winding layer, has been disclosed by U.S. Pat. No. 3,257,087, for example. The wire raising up detectors disclosed by this patent are disposed adjacent to both flanges of a reel and each comprise a shoe to engage the wire wound on the reel so as to pivotally move about the axis normal to that of the reel, and a mercury switch mounted on the shoe. When the wire begins to be wound as a first turn of a new winding layer at either of the reel flanges, the shoe is tilted about the pivotal axis by raising up of the wire. Thus, the mercury switch is closed so that it produces an electric signal indicating raising up of the wire. One of the disadvantages of the prior art detector is that each time the outer diameter of the wire to be taken up varies, the mercury switch should be replaced by another having a tilted angle at which it is closed. Therefore, a particular mercury switch having a particular tilted angle at which it is closed, cannot detect raising up of the wires having various outer diameters. Another disadvantage of the prior art is that in case the reel flange is deformed without having a plane accurately normal to the axis of the reel, the detector cannot effectively detect raising up of the wire. Further disadvantage of the prior art is that the mercury switch which tends to be subject to impact due to engagement with the reel flange rotating at high speed, has an unstable operation, and that the detector tends to be injured due to the impact. Thus, with the prior art the wire cannot be taken up on the reel at the high speed.

SUMMARY OF THE INVENTION

Accordingly, it is a principle object of the present invention to provide a wire take up apparatus wherein a particular detector is adapted to detect raising up of wires having various outer diameter.

It is another object of the present invention to provide a wire take up apparatus adapted to effectively detect raising up of a wire adjacent to either of the reel flanges even though the reel flanges are distorted.

It is further object of the present invention to provide a wire take up apparatus at least one wire raising up detector which can be stably operated while the apparatus is driven at high speed.

In accordance with the present invention, there is provided a wire take up apparatus comprising a distributor to distribute a wire to be taken up on a reel along the axis of said reel, and wire raising up detecting means to electrically detect that a first turn of a new winding layer of said wire is being raised up on said reel adjacent to either of the flanges of said reel, an output signal from said detecting means instructing said distributor to be reversed, characterized by that said wire raising up detecting means comprises at least two adjacent arms pivotally mounted on a fixed axis parallel to the axis of said reel and spring-loaded to be engaged against said wire wound on said reel; and an angular-electro converter to convert the angle at which said arms are pviotally moved relative to each other into an electric signal having the amplitude proportional to the angle.

BRIEF DESCRIPTION OF THE DRAWINGS

The above and other objects and features of the present invention will be apparent from the description of the preferred embodiments taken with reference to the accompanying drawings in which.

DETAILED DESCRIPTION OF PREFERRED EMBODIMENTS

Figure 1:
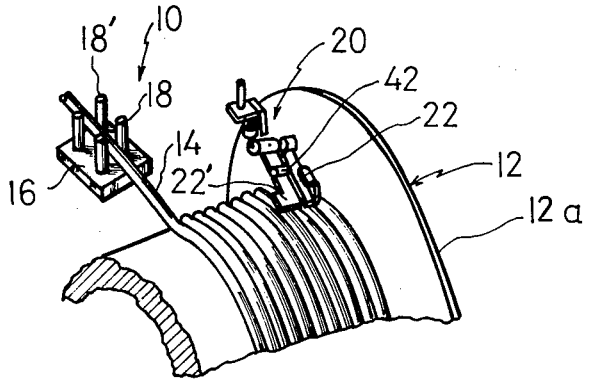
FIG. 1 is a fragmentarily and schematically perspective view of an electric cable take up apparatus according to the present invention.

Referring now to FIG. 1, an electric cable take up apparatus 10 is schematically illustrated. A reel 12 is rotatably supported on spindles not shown and an electric cable 14 is taken up on the reel 12 by its rotation while the cable is traversed or distributed by a traverser or distributor 16 along the axis parallel to the axis of the reel 12.

The distributor 16 is schematically shown to comprise a front pair of guide rollers 18 and a rear pair of guide rollers 18' which may be movable by a drive mechanism not shown along the axis parallel to the axis of the reel 12.

Adjacent to the flanges 12*a* and 12*a* of the reel 12 are provided cable raising up detectors 20 and 20' which electrically detect raising up of the cable 14 on the reel as the cable starts a new winding layer on the underside winding layer at the inner face of either of the reel flanges 12*a* when the distributor 16 reaches that reel flange. The detectors 20 and 20' may be adjusted in position by a detector position adjustment mechanism, so that they are moved upwardly or downwardly and laterally along the axis parallel to the axis of the reel 12 so as to align them with both ends of the reel. The detectors 20 and 20' electrically detect raising up of the cable on the underside winding layer when it starts a new winding layer, to produce an electric signal which instructs a power supply for the distributor to stop and be then reversed. After the power supply for the distributor is supplied with the electric signal, it is reversed when a complete first turn of the new winding layer is taken up.

Figure 5:
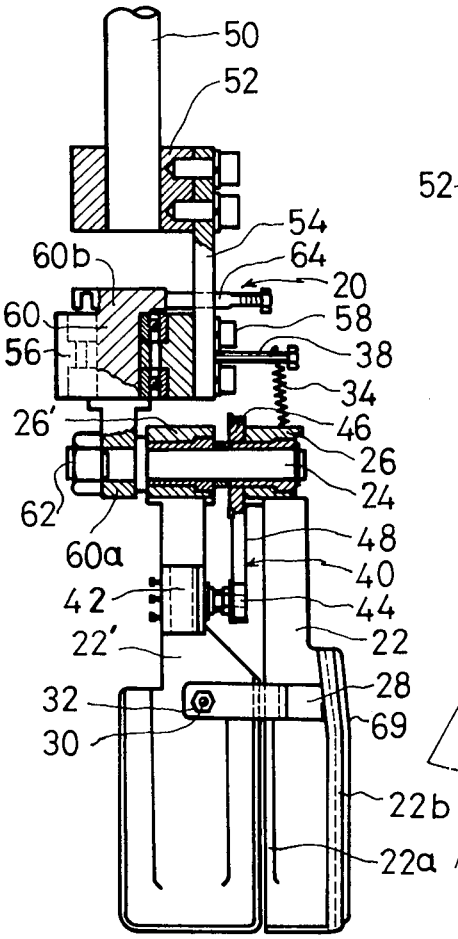
FIG. 5 is an enlarged front view of one of the detectors of FIGS. 1 to 4.
Figure 6:
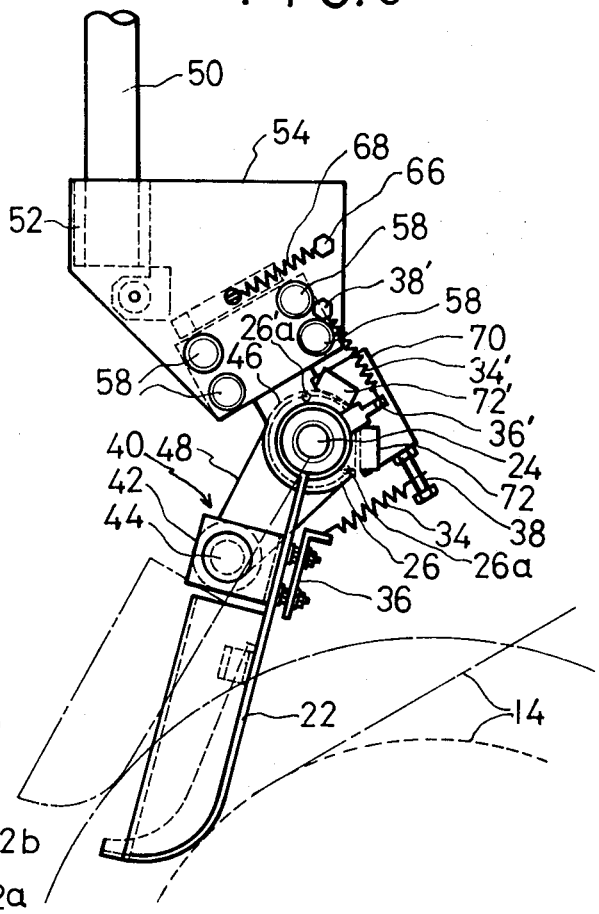
FIG. 6 is a side elevational view of the detector of FIG. 5.
Figure 7:
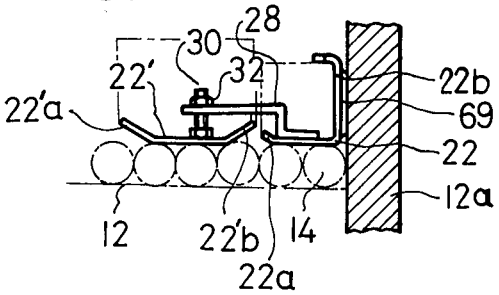
FIG. 7 illustrates the relation of the detector of FIGS. 5 and 6, an electric cable and a reel.

The detector 20 is shown in FIGS. 5 to 8 in more details. The other detector 20' is substantially identical to the detector 20, and therefore, not described in detail. In the illustrated embodiment, the detector 20 may comprise first and second arms 22 and 22', which are rotatably supported on respective bearings 26 and 26' on a shaft 24 having the axis parallel to that of the reel 12. As shown in FIGS. 5 and 7, the first arm 22 at the left edge may be provided with an outwardly upward inclining edge 22*a* which serves to facilitate its upwardly pivotal movement when the cable 14 is raised up, while the right edge of the first arm 22 may be provided with a vertical wall 22*b* which is engageable with one of the reel flanges 12*a*. The second arm 22' at both edges may be provided with outwardly upward inclining edges 22'*a* and 22'*b* which serve to facilitate its upwardly pivotal movement when the cable 14 is raised up. As shown in FIG. 7, the first arm 22 may have a reverse L-shaped stop 28 at the right end secured thereto by any suitable means such as welding, while the left end of the stop 28 may extend over the second arm 22' and have a bolt 30 which may be in turn threadedly engaged with a nut 32 welded to the stop 28 at the left end. The bolt 30 normally rides on the top of the second arm 22'. Therefore, when the first arm 22 is upwardly and pivotally moved about the shaft 24 by the cable 14 raised up from the relative position as shown in FIG. 7, the second arm 22' remains to be held in position, but when the second arm 22' is upwardly and pivotally moved, the first arm 22 is also raised up together with the second arm 22'. A spring 34 may be tensioned between a member 36 secured to the first arm 22 at the back thereof and a bolt 38 secured to a switch holder later described, so as to urge the first arm 22 against the cable 14 wound on the reel. Similarly, a spring 34' is tensioned between a projection 36' on the bearing 26' and a bolt 38' secured to a bracket 54, so as to urge the second arm 22' against the cable 14 would on the reel.

The detector 20 further comprises an electrically detecting element 40 to electrically detect the angle at which the first arm 22 is pivotally and upwardly moved relative to the second arm 22'. This element may comprise a rotating angle measuring device 42 mounted on the second arm 22', and a belt 48 which is tensioned between the input pully 44 of the device 42 and the outer race of the bearing 26 for the first arm 22 rotates the element to produce an electric signal. This rotating angle measuring device 42 may be in the form of a potentiometer, a selsyn motor or a diferential transformer. Thus, when the first arm 22 is angularly moved relative to the second arm 22' as shown at phantom line in FIG. 6, the device 42 is rotated by the belt 48 in the same direction to produce an electric signal having the amplitude proportional to the angle at which the first and second arms 22 and 22' are relatively moved. A distributor drive circuit (not shown) which is supplied with the signal from the device 42 includes a delay circuit section to delay the movement of the distributor until a generally complete first turn of the new winding layer of the cable 14 is wound. Then, the drive circuit drives the distributor 16 in the reverse direction in accordance with the signal. It should be noted that since the device 42 produces the electric signal having the amplitude proportional to the angle on movement of the first arm 22, the amplitude of the signal at which the distributor drive circuit operates may be positively determined in correspondence to the outer diameter of the cable to be taken up. Thus, it will be understood that the particular angle measuring device 42 may be applicable to any cables having various outer diameters. The cable 14 starts a new winding layer at the opposite reel flange 12*a* and is then distributed from the left to the right until it again reaches the right reel flange 12*a*, but at the time, the second arm 22' is firstly raised up while the first arm 22 is also raised up together, with the result that there occurs no relatively angular movement of the arms 22 and 22' so that no electric signal is produced from the angle measuring device 42.

Figure 2:
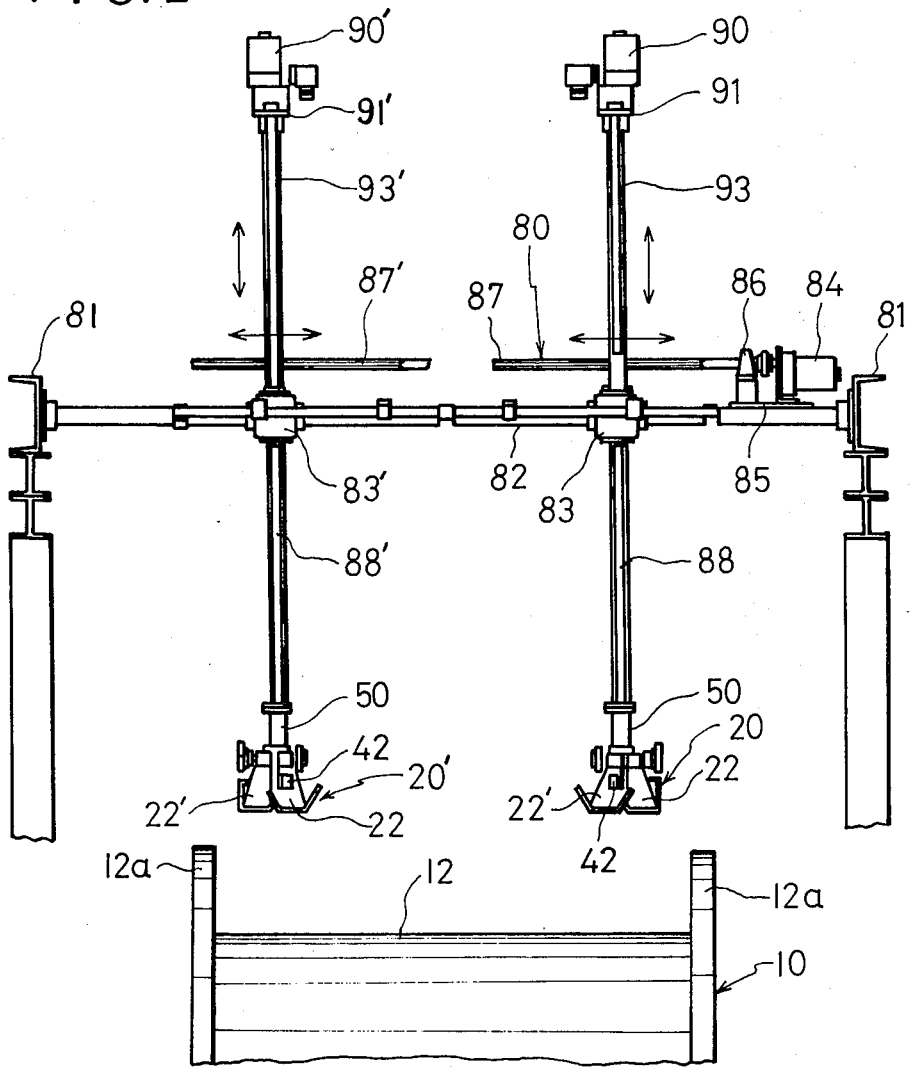
FIG. 2 is a front view of cable raising up detectors mounted through a detector position adjustment mechanism on a frame of the electric cable take up apparatus so as to enable adjustment in position.
Figure 3:
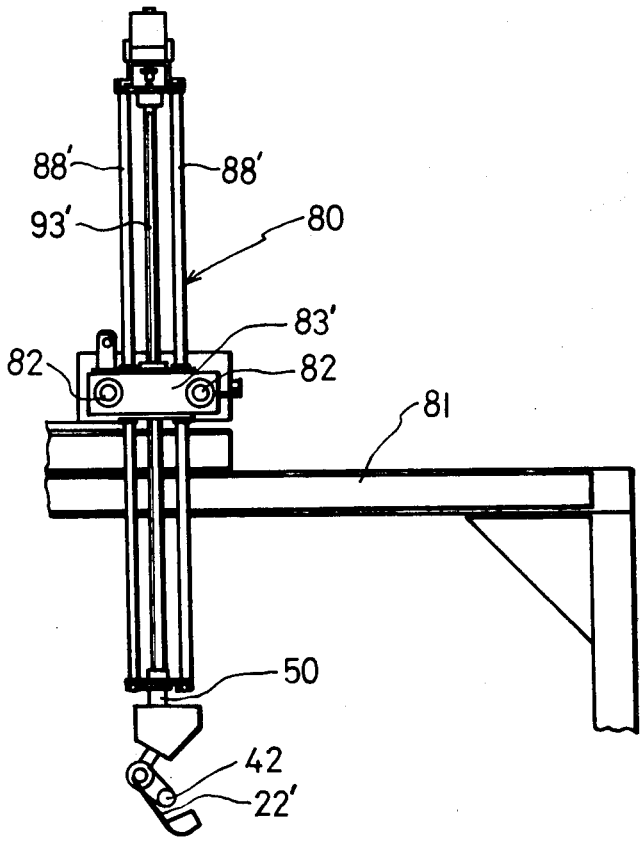
FIG. 3 is a side elevational view of the detectors of FIG. 2.
Figure 4:
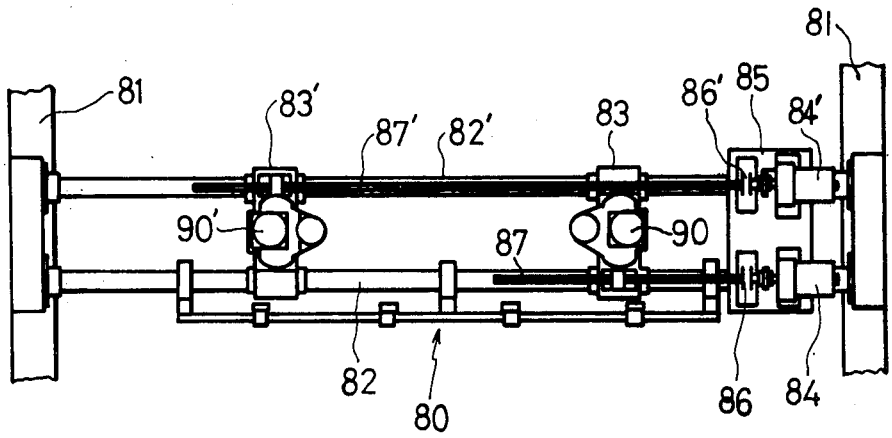
FIG. 4 is a top view of the position adjusting mechanism of FIG. 2.
Figure 8:
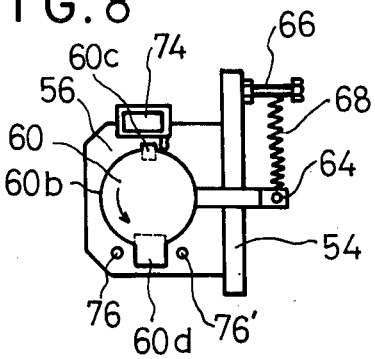
FIG. 8 is a top view of a pivotal shaft of the detector of FIGS. 5 and 6 and the bearing assembly thereof.
Figure 11:
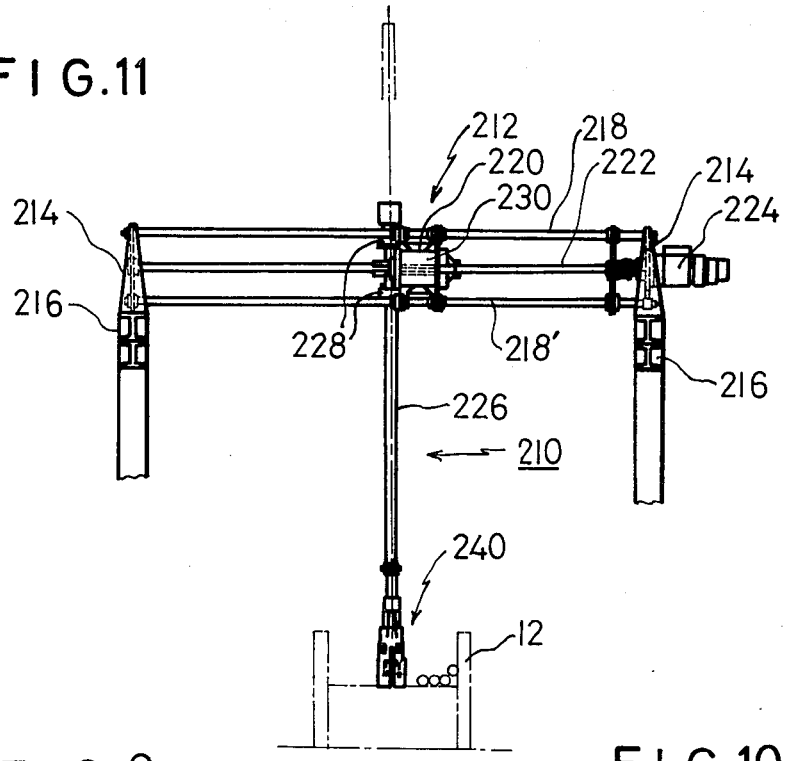
FIG. 11 is a front view of an electric cable take up apparatus according to another embodiment of the present invention.

The detector 20 may be provided with a mounting rod 50 to mount it on a detector position adjustment mechanism as shown in FIGS. 2 to 4. The mounting rod 50 may be secured through a collar 52 to the bracket 54 (FIGS. 5 and 6). As shown in FIG. 5, on the bracket 54 may be securedly mounted by screws 58 a bearing assembly 56, which has a pivotal shaft 60 vertically extending therethrough and supported thereon. The shaft 24 on which the arms 22 and 22' are pivotally mounted, may extend through a lower extension 60*a* of the pivotal shaft 60 and be securely mounted thereon by a nut 62 threadedly engaged with the projection of the shaft 24. Thus, it will be noted that the detector 20 can be pivotally moved about the axis of the pivotal shaft 60. As also shown in FIG. 5, the pivotal shaft 60 at the upper end may be with an enlarged head 60*b*, to which is secured a radially and outwardly extending rod 64. A spring 68 may be tensioned between the extending rod 64 and a bolt 66 secured to the bracket 54, so as to urge the arms 22 and 22' in the counter-clockwise direction as shown in FIG. 8 so that the vertical wall 22*b* is engaged against the inner face of the reel flange 12*a*. Thus, it will be noted that even though the reel flange 12*a* is deformed, the first arm 22 can closely engage the flange 12*a* following the deformation. In order to prevent wear of the arm 22 due to close engagement of the arm with the flange 12*a*, the vertical wall 22*b* of the arm 22 at the outer face may be preferably covered with a wear-resisting layer as made of teflon. Numerals 76 and 76' designate stops provided on the bearing assembly 56 to abut against another projection 60*d* on the enlarged head 60*b* of the pivotal shaft.

Limit switches 72 and 72′ (FIG. 6) are mounted on a holder 70 provided on the extension 60*a* of the pivotal shaft 60 to be operable by projections 26*a* and 26′*a* of the bearings 26 and 26′. The limit switch 72 is operated when the first and second arms 22 and 22′ are lifted by raising up of the cable 14, to produce and supply to the detector position adjustment mechanism of FIGS. 2 to 4 an electric signal instructing the detector 20 to upwardly move at the distance equal to the outer diameter of the cable 14. The other limit switch 72′ is operated when the detector 20 is lowered by the detector position adjustment mechanism from the position as shown in FIG. 2 wherein it does not engage the reel 12 until it engages the reel, to produce and supply to the mechanism an electric signal instructing the detector to stop lowering.

A limit switch 74 which is operable by a projection 60*c* provided on the enlarged head 60*b* of the pivotal shaft 60 is mounted on the top of the bearing assembly 56. This limit switch is operated when the detector 20 is lowered from the non-operating position of FIG. 2 until it engages the reel 12 and further moves laterally toward the reel flange 12*a* until the first arm 22 abuts the reel flange 12*a* so that it is horizontally and pivotally moved against the spring 68, to produce and supply to the detector position adjustment mechanism an electric signal instructing the detector to stop its lateral movement.

The detector 20′ has a substantially identical construction and the same numerals designate the same components.

A detector position adjustment mechanism 80 which serves to move the detectors 20 and 20′ to the predetermined positions relative to the reel 12 is shown in FIGS. 2 to 4 in detail. Two guide rods 82 and 82′ are secured between upper frames 81 of the cable take up apparatus 10 and two carriages 83 and 83′ are slidably mounted on the rods 82 and 82′. Electric motors 84 and 84′ are mounted on a base 85 disposed between and secured to the rods 82 and 82′ and supply torques to screws 87 and 87′ through clutches 86 and 86′ also mounted on the base 85. The screws 87 and 87′ hold and traverse the carriages 83 and 83′. As later described, the carriages 83 and 83′ carry the detectors 20 and 20′, respectively and therefore, the motors 84 and 84′ may adjust the lateral position of the detectors 20 and 20′ so that they engage the respective reel flanges 12*a*. Vertical guide rods 88 and 88′ slidably extend through the respective carriages 83 and 83′ and the mounting rods 50 of the detectors 20 and 20′ are secured to the guide rods 88 and 88′ at the lower ends thereof, respectively. Electric motors 90 and 90′ are mounted on bases 91 and 91′ provided on the top ends of the guide rods 88 and 88′ and drive screws 93 and 93′ extending parallel to the rods 88 and 88′ and threadedly engaging the carriages 83 and 83′. Thus, the motors 90 and 90′ may move the detectors 20 and 20′ upwardly and downwardly. The motors 84 and 84′ are stopped by the signal from the afore-mentioned limit switch 74, while the motors 90 and 90′ are stopped by the signals from the limit switches 72 and 72′, respectively.

In operation, the detectors 20 and 20′ are shown in FIG. 2 to occupy the non-operating position wherein they are withdrawn upwardly from the reel 12. When the electric motors 90 and 90′ are energized, the detectors 20 and 20′ are lowered until they engage the reel. Then, the limit switch 72′ produces the electric signal to deenergize the electric motors 90 and 90′. Thereafter, the electric motors 84 and 84′ are energized, the detectors 20 and 20′ are laterally moved toward the reel flanges 12*a* until they engage the respective flanges. Then, the limit switch 74 produces the electric signal to deenergize the electric motors 84 and 84′. While the apparatus is operated, the arms 22 and 22′ of the detectors 20 and 20′ are spring-loaded against the cable on the reel as shown in FIG. 7 and when the cable starts the new winding layer and is raised up at either of the flanges 12*a*, the angle measuring device 42 produces the electric signal. As afore-mentioned, the signal is supplied to the distributor drive circuit to reverse the distributor when a substantially complete first turn of the new winding layer is wound. In this manner, while the cable is taken up on the reel while being traversed from the reel flange 12*a* toward the middle of the reel, the other arm 22′ is raised up by the cable and the limit switch 72 then produces the signal which causes the corresponding electric motor 90 or 90′ to be driven so as to lift the detector 20 or 20′ at the distance equal to the outer diameter of the cable 14. Lifting the detector 20 or 20′ permits the first and second arms 22 and 22′ to engage the cable on the reel in the same attitude. Thus, it should be noted that the amplitude of the output signal from the angle measuring device 42 never varies according to the winding diameter of the cable. As apparent from the foregoing, the detectors 20 and 20′ can effectively detect starting of the new winding layer of the cable so that the distributor 16 can be reversed.

Figure 9:
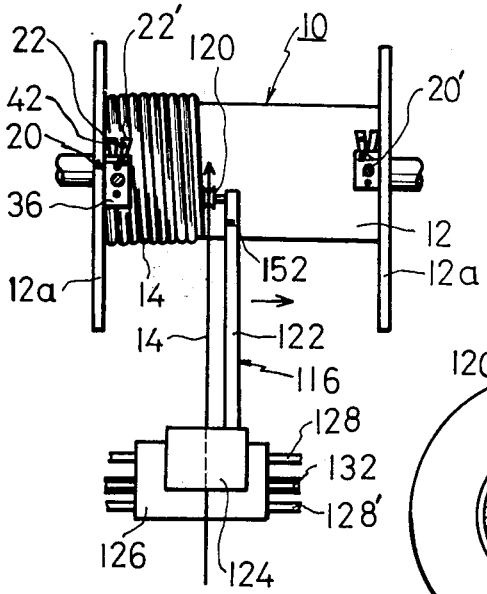
FIG. 9 is a top view of a modification of the apparatus shown in FIGS. 2 to 8, but the position adjustment mechanism being omitted.
Figure 10:
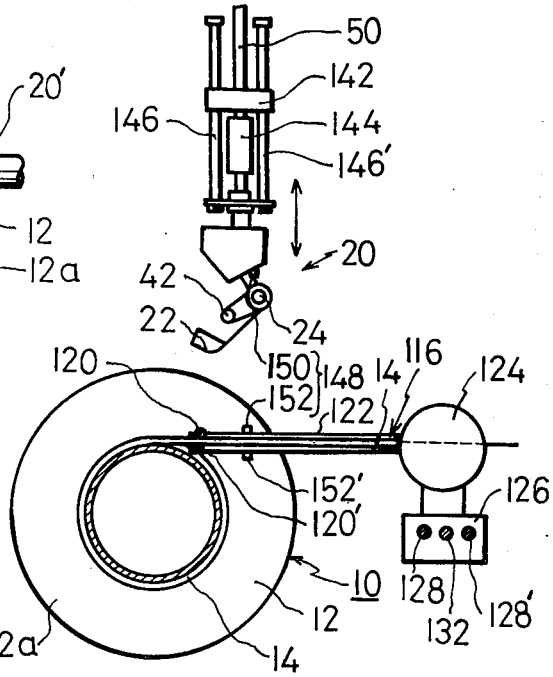
FIG. 10 is a side elevational view of the electric cable take up apparatus of FIG. 9.

Referring now to FIGS. 9 and 10, there is shown another embodiment of the present invention wherein the same numerals designate the same components. In this embodiment, the distributor 116 may comprise a traversing elongate arm 122 on which are provided at least one pair of freely rotatable upper and lower guide rollers 120 and 120′ that hold and guide the cable 14. The elongate arm 122 at the base portion may be mounted through an arm rotating mechanism 124 on a carriage 126. The arm rotating mechanism 124 serves to rotate the arm 122 at the angle of 180° about the axis of the cable when the traversing arm 122 reaches either of the reel flanges 12*a*, so that the guide rollers 120 and 120′ always face the reel flange which is located behind the distributor 14 in the traversing direction as shown by an arrow in FIG. 9. In FIG. 9, the guide rollers 120 and 20′ are shown to face the left reel flange 12*a*, but when the traversing arm 122 aproaches the right reel flange 12*a*, the arm rotating mechanism 124 rotates the traversing arm 122 at the angle of 180° and causes the guide rollers 120 and 120′ to face the right reel flange 12*a* so that they permit the cable 14 to be wound until the last turn of the winding layer. The carriage 126 may be reciprocated by forward and reverse rotation of a screw 132 threadedly engaging the carriage while it is guided by guide rods 128 and 128′ extending through the carriage.

The cable raising up detectors 20 and 20′ are substantially identical to those of the afore-mentioned embodiment. The mechanism to adjust the position of the detectors is substantially identical to that of the afore-mentioned embodiment except that the carriages 83 and 83′ as shown in the afore-mentioned embodiment may be secured directly to the mounting rods 50 if the detectors 20 and 20′ and that a hydraulic cylinder 144 is mounted on a frame 142 provided on the lower end of either the mounting rods 50 and has a piston rod mounted on either of the detectors 20 and 20'. Guide rods 146 and 146' are secured to either of the detectors 20 and 20' and extend through the frame 142. Thus, it will be noted that the detectors 20 and 20' may be movable by extension and withdrawal of the piston rod of the hydraulic cylinder 144 between the operating position in which they engage the cable on the reel and the non-operating position in which they are away from the cable on the reel as shown in FIG. 10.

A winding layer termination detecting means 148 may be provided which electrically detects the guide rollers 120 and 120' of the distributor 116 having reached the last turn of one winding layer. The detecting means may comprise a projector and phototube 150 mounted on the brackets of the detectors 20 and 20', and reflectors 152 and 152' mounted on the traversing arm 122 of the distributor 116 to face the projector and phototube 150 when the guide rollers 120 and 120' reach the last turn of one winding layer of the cable. Thus, when the traversing arm 122 aproaches the detector 20 or 20' so that the guide rollers 120 and 120' reach the last turn of one winding layer, a light projected by the projector and phototube 150 is reflected by the reflector 152 and 152' and received by the projector and phototube 150 which in turn produces an electric signal. The signal causes the hydraulic cylinder 144 of the corresponding detector 20 or 20' or to extend so that the detector 20 or 20' is lowered until it engages the cable on the reel. Thus, the detector 20 or 20' occupies the operating position in which when it detects starting of a new winding layer of the cable, it is instructed that the distributor 116 be reversed at the same time that the first turn of the new winding layer is substantially completed, and that the hydraulic cylinder 144 be withdrawn. In this manner, the detector 20 or 20' is returned to the non-operating position as shown in FIG. 2. With the embodiment of FIGS. 9 and 10, since the detectors 20 and 20' are normally far away from the cable on the reel, the arms 22 and 22' are prevented from wear due to the cable and the reel operated at high speed.

Referring now to FIGS. 11 to 15, there is shown another embodiment wherein the same numerals designate the same components. In this embodiment, a single cable raising up detector 240 may be used, which may be movable together with the distributor (not shown) to electrically detect raising up of the cable at either of the reel flanges 12*a* as well as winding of the cable during traversing it to control the delay or lead of movement of the distributor. This embodiment is substantially identical to the afore-mentioned embodiments except for the above description. A detector position adjustment mechanism 212 may comprise a pair of right and left upper frames 214 which are in turn secured by vertical frames 216 to a base of the cable take up apparatus not shown. Between the upper frames 214 are secured two guide rods 218 and 218' between which is mounted a carriage 220 that laterally moves along the axis parallel to the axes of the guide rods 218 and 218'. The carriage 220 may have a screw 222 extending through and threadedly engaging the carriage. The screw 222 may be rotatably supported between the upper frames 214. A traversing electric motor 224 which may comprise a DC servomotor may be mounted on one of the upper frames 214 and connected to the screw 222. Thus, when the traversing electric motor 224 rotates in one direction, the carriage 220 moves in one of the lateral directions, and when the motor rotates in the other direction, the carriage moves in the reverse direction.

A vertical rod 226 on the lower end of which the detector 240 is mounted may extend through guide eyes 228 carried by the carriage 220, so that it is vertically slidable along its axis. An electric motor 230 which vertically drives the vertical rod may be mounted on the carraige 220. The motor may preferably comprise a geared motor, the output shaft (not shown) of which may be meshed with a rack (also not shown) provided on the vertical rod 226. Thus, when the motor 230 rotates in one or another direction, the vertical rod 226 and the cable raising up detector 240 mounted on the lower end of the rod are lowered toward the reel 12 or lifted far away from the reel.

Figure 12:
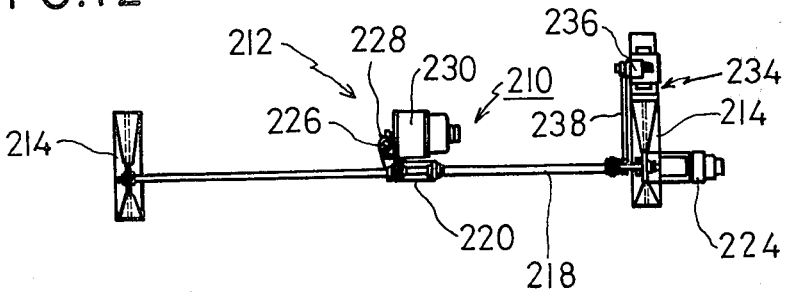
FIG. 12 is a top view of the apparatus of FIG. 11.

As shown in FIG. 12, the detector position adjustment mechanism 212 may include a position detector 234 to detect the traverse distance of the mechanism and may comprise a pulser 236 mounted on one of the upper frames 214. The pulser 236 may be driven from the screw 222 through a gearing such as a pully-belt assembly 238 to produce a pulse each time the cable raising up detector 240 is traversed. This pulse may be used for controlling the cable take up apparatus in various manners such as controlling the operation of the distributor.

Figure 13:
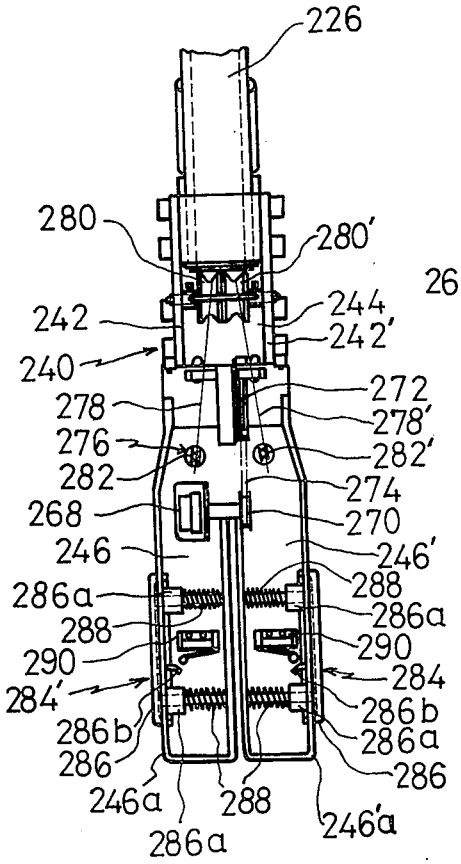
FIG. 13 is an enlarged front view of the cable raising up detector used in the electric cable take up apparatus of FIG. 11.
Figure 14:
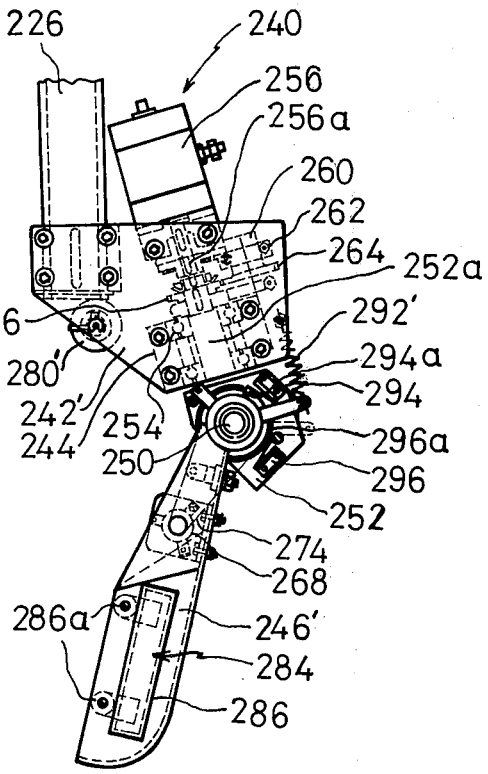
FIG. 14 is a side elevational view of the detector of FIG. 13.
Figure 15:
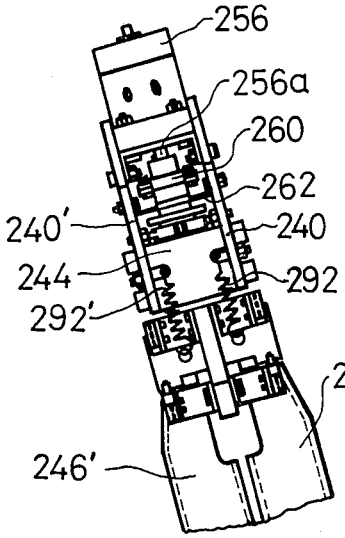
FIG. 15 is a fragmentary back view of the detector of FIG. 13.
Figure 16A:
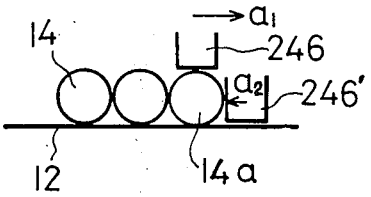
FIGS. 16A and 16B illustrate how the cable raising up detector of FIGS. 11 to 15 electrically detects a wire on a reel while the distributor distributes the wire.
Figure 16B:
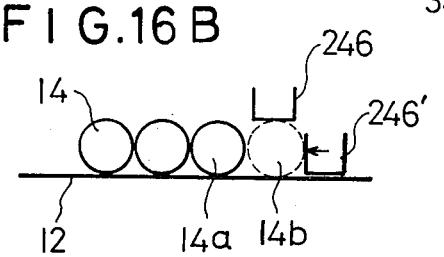

The cable raising up detector 240 is illustrated in FIGS. 13 to 15 in detail. This detector may comprise a pair of right and left frames 242 and 242' secured to the lower end of the vertical rod 226 of the detector position adjustment mechanism 212, and a block 244 mounted between the frames 242 and 242'. A pair of arms 246 and 246' are closely disposed side by side as shown in FIG. 13 and rotatably supported at the base portions on a lateral shaft 250 as shown in FIG. 14. The lateral shaft 250 may be secured to a shaft supporting member 252, which has a shaft 252*a* supported through a bearing 254 on the block 244 so as to be rotatable about the generally vertical axis (FIG. 14). Thus, the arms 246 and 246' can be pivotally moved about the generally vertical axis in the leftward or rightward direction as viewed in FIG. 12. A hydraulic rotary actuator 256 which urges the arms 246 and 246' to be rocked in the direction reverse to the traversing direction (as shown at an arrow $a_1$ of FIG. 16A) of the detector 240, may be secured to and between the frames 242 and 242' and the output shaft 256*a* of the actuator may be connected to the shaft 252*a* of the shaft supporting member 252. Thus, as shown in FIG. 16A, the arm 246' leading in the traversing direction is urged to be forced against the cable portion 14*a* of the last turn of the cable 14 as shown at an arrow $a_2$. Whenever a cable portion 14*b* of a new turn is wound adjacent the cable portion 14*a* as shown in FIG. 16B, the arm 246' together with the arm 246 is rocked rightwardly, so that the shaft 252*a* of the shaft supporting member 252 is forcely rotated about the generally vertical axis in the direction reverse to the urged direction against the actuator 256.

A rocking angle detector 260 may be provided which electrically detects the rocking angle at which the arms 246 and 246' are rocked and may comprise a potentiometer, for example, which may be securely mounted on the bracket 262 between the frame 242 and 242'. The input shaft of the rocking angle detector 260 is provided with a gear 264 which is meshed with a gear 266 secured to the shaft 252*a* of the shaft supporting member 252. Thus, whenever the arms 246 and 246' are rocked by a new turn of the cable, as shown in FIG. 16B, the rocking angle detector 260 produces an electric signal which controls the traversing motor 224 of the detector position adjustment mechanism 212 to be driven until the cable raising up detector 240 moves to a new position in which the arms are returned to the attitude as shown in FIG. 16A. In the case the detector 240 is traversed in the direction reverse to the arrow $a_1$ of FIG. 16A, the other arm 246 is forced against the last turn of the cable symmetrically of the foregoing condition so that the operation is similarly accomplished. The number of the pulses produced from the position detector 234 by traverse movement of the cable raising up detector 240 may be compared with that of the pulses produced from a pulse generator not shown by traverse movement of the distributor at a constant pitch, so that delaying or leading movement of the distributor may be controlled so as to make the delaying or leading distance of the distributor constant or varied as long as the last few turns are concerned.

Figure 17A:
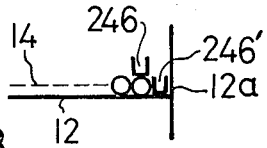
FIGS. 17A to 17D illustrate how the detector of FIGS. 11 to 15 electrically detects raising up of the wire adjacent to one of the reel flanges.
Figure 17B:
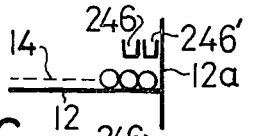
Figure 17C:
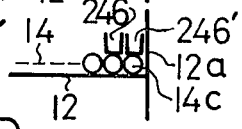
Figure 17D:
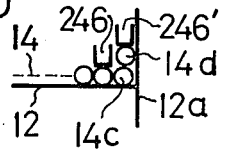

The cable raising up detector 240 comprises a rotating angle detecting element 268 to detect the relative rotating angle of the arms 246 and 246′ about the horizontal axis of the lateral shaft 250 in order to detect raising up of a new winding layer on the underside winding layer of the cable 14 adjacent to either of the reel flanges 12*a*. This element 268 may comprise a potentiometer as described in connection with the afore-mentioned embodiments. The rotating angle detecting element 268 may be mounted on the arm 246, and the input shaft of the element may be provided with a pully 270 which has a belt 274 tensioned between the pully 270 and a pully 272 provided on the base portion of the other arm 246′. Thus, whenever the cable 14 reaches one of the reel flanges 12*a* as shown in FIG. 17A so that the arm 246′ engages the reel flange, the arms 246 and 246′ are driven by an electric signal from a flange detector later described, so as to be pulled up as shown in FIG. 17B and after the cable is wound as the last turn of the underside winding layer, the arms are lowered until they ride on the underside winding layer as shown in FIG. 17C. When a first turn of a new winding layer is wound from the above condition to raise the cable on the underside winding layer as shown in FIG. 17D, the arm 246′ is upwardly and pivotally moved about the horizontal axis relative to the other arm 246 so that the pully 272 is rotated so as to produce the electric signal from the rotating angle detecting element 268. The output signal from the rotating angle detecting element 268 instructs a control circuit for the distributor and the cable raising up detector position adjustment mechanism 212 to reverse the distributor and the cable raising up detector 240 after completing a time interval at which a first turn of the cable 14 is substantially wound.

An arm lifting mechanism 276 which serves to lift the arms 246 and 246′ so as to be far away from the cable 14 on the reel as shown in FIG. 17B may comprise two wires 278 and 278′, one ends of which may be connected to a wire hoist not shown and the other ends of which are connected by respective fixtures 282 and 282′ to the arms 246 and 246′ with guide rollers 280 and 280′ rotatably mounted on the respective frames 242 and 242′ and disposed so that the wires pass through the guide rollers 280 and 280′, respectively. Flange detectors 284 and 284′ which electrically detect engagement of the arms 246 and 246′ with the reel flanges 12*a*, respectively, comprise flange engaging movable pieces 286 each having two legs 286*a* extending through the outside wall 246*a* or 246′*a* of the arm 246 or 246′ and normally urged by springs 288 to be slightly away from the respective outside walls 246*a* and 246′*a*, and limit switches 290 operable by protrusions 286*b* of the pieces 286 when the movable pieces abut the reel flanges 12*a* to be withdrawn against the springs 288. When the flange detector 284 or 284′ produces an output signal, the arm lifting mechanism is operated by the signal as afore-mentioned. Furthermore, the signal instructs the actuator 256 to be reversed so that the arm 246 is now urged to be rocked in the rightward direction as viewed in FIG. 17. Thus, the arm 246 is forced against the new turn 14*d* of the cable at the position of FIG. 17D.

In order to assure engagement of the arms 246 and 246′ with the cable on the reel during its engagement, there may be provided springs 292 and 292′ (FIGS. 14 and 15), one ends of which may be secured to the block 244 and the other ends of which may be secured to the base portions of the arms 246 and 246′, respectively. A limit switch 296 which is mounted on the shaft supporting member 252 may be operable by a cam surface 296*a* of the arms 246 and 246′ when the cable raising up detector 240 is continuously lowered by the mechanism 212 from the non-operating or upper position in which the detector is far away from the reel 12 to the non-operating or lower position, to engage the arms 246 and 246′ with the drum of the reel 12, and it serves to stop the electric motor 230 when it is operated. Similarly, a limit switch 294 which may be mounted on the shaft supporting member 252 may be operable by a cam surface 294*a* of the arms 246 and 246′ when they are lifted by raising up of the cable on the reel, and it produces an electric signal to instruct the cable raising up detector position adjustment mechanism to lift the detector 240 at the distance equal to the outer diameter of the cable 14.

With the embodiment of FIGS. 11 to 17, since the distributor is controlled by comparing the position of the cable during its winding or the distance of this position from the reel flange with the actual position of the distributor, it can be accurately traversed even though the cable take up is accomplished at high speed. Also, it will be noted that only one cable raising up detector detects raising up of the cable at the reel flanges, riding of the cable on way of the reel, and the position of the cable to simultaneously control the reverse and traverse movements of the distributor.

Figure 18:
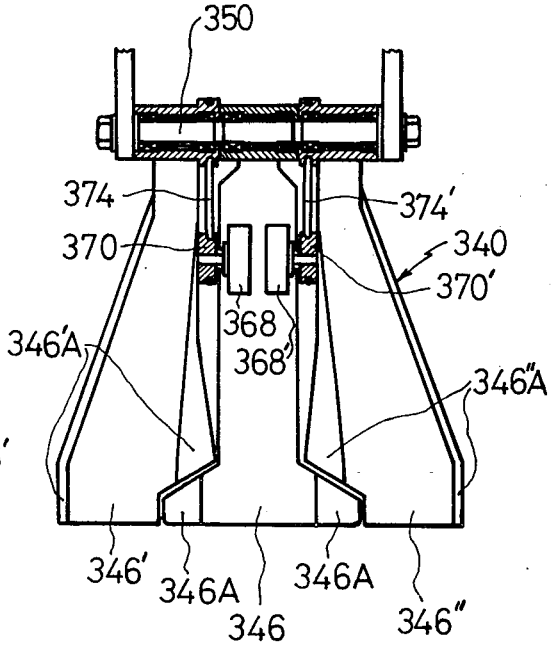
FIG. 18 is a fragmentary front view of a modified electric cable raising up detector used by the present invention.

FIG. 18 illustrates a modified cable raising up detector 340 used in the present invention. The detector may comprise three adjacent arms 346, 346′ and 346″ rotatably supported on a shaft 350, and two detecting elements 368 and 368′ mounted on the arm 346. The detecting element 368 electrically detects the relative angular movement of the arms 346 and 346′ while the detecting element 368′ electrically detects the relative angular movement of the arms 346 and 346″. The detector 340 corresponds to combination of the two detectors 20 and 20′ of FIGS. 1 to 8. Accordingly, the detector may be movable together with the distributor along the axis of the reel and at one of the reel flanges the detecting element 368 is operated while at the other reel flange the detecting element 368′ is operated.

Although some preferred embodiments of the present invention have been illustrated and described with reference to the accompanying drawings, it will be understood that they are by way of examples and that the invention is not intended to be limited thereto. For example, the invention may be applicable to taking up a wire other than an electric cable in an arranged manner. It will be apparent to those skilled in the art that various changes and modifications may be made without departing from the spirit and scope of the present invention, which is intended to be defined only to the appended claims.

What is claimed is;

1. A wire take up apparatus comprising a distributor to distribute a wire to be taken up on a reel along the axis of said reel, and wire raising up detecting means to electrically detect that a first turn of a new winding layer of said wire is being raised up on said reel adjacent to either of the flanges of said reel, an output signal from said detecting means instructing said distributor to be reversed, characterized by that said wire raising up detecting means comprises at least two adjacent arms pivotally mounted on a fixed axis parallel to the axis of said reel and spring-loaded to be engaged against said wire wound on said reel; and an angular-electro converter to convert the angle at which said arms are pivotally moved relative to each other into an electric signal having the amplitude proportional to the angle.

2. A wire take up apparatus comprising a distributor to distribute a wire to be taken up on a reel along the axis of said reel, and wire raising up detecting means to electrically detect raising up of said wire as a first turn of a new winding layer of said wire on said reel adjacent to either of the flanges of said reel, an output signal from said detecting means instructing said distributor to be reversed, characterized by that said wire raising up detecting means comprises two detectors each including two adjacent arms pivotally mounted on a fixed axis parallel to the axis of said reel and spring-loaded to be engaged against said wire wound on said reel and an angular-electro converter to convert the angle at which one of said arms adjacent to either of said reel flanges is pivotally moved relative the other arm into an electric signal having the amplitude proportional to the angle; and a detector position adjustment mechanism to move said two detectors between the operating position in which said detectors engage said wire on said reel and the non-operating position in which said detectors are away from said wire on said reel in an individual manner and to adjust the distance between said two detectors along the axis parallel to the axis of said reel in an individual manner.

3. A wire take up apparatus as set forth in claim 2, wherein said two arms of each of said detectors are rotatable about a generally vertical axis normal to said pivotal axis of said arms and either of said arms adjacent to either of said reel flanges is spring-loaded to be normally engaged against the corresponding reel flange.

4. A wire take up apparatus as set forth in claim 2, wherein each of said detectors normally occupies said non-operating position and further comprising a winding layer termination detecting means to electrically detect that said wire reaches either of said reel flanges, an output signal from said winding layer termination detecting means instructing said detector position adjustment mechanism to move said detectors of said wire raising up detecting means to said operating means.

5. A wire take-up apparatus as set forth in claim 4, wherein said winding layer termination detecting means comprises a photo-electric system provided between said distributor and said wire raising up detectors to be operable when said winding layer termination detecting means and said wire raising up detectors are aligned with each other.

6. A wire take up apparatus comprising a distributor to distribute a wire to be taken up on a reel along the axis of said reel, and wire raising up detecting means to electrically detect raising up of said wire as a first turn of a new winding layer of said wire on said reel adjacent to either of the flanges of said reel, an output signal from said detecting means instructing said distributor to be reversed, characterized by that said wire raising up detecting means comprises a single wire raising up detector including at least two adjacent arms pivotally mounted on a fixed axis parallel to the axis of said reel and spring-loaded to be engaged against said wire wound on said reel and an angular-electro converter to convert the angle at which either of said arms adjacent to either of said reel flanges is pivotally moved relative to the other arm into an electric signal having the amplitude proportional to the angle; and a detector position adjustment mechanism to move said wire raising up detector between the operating position in which said detector engages said wire on said reel and the non-operating position in which said detector is away from said wire on said reel and to reciprocate said detector between said reel flanges.

7. A wire take up apparatus as set forth in claim 6, wherein said detector occupies said operating position in which it normally engages said wire on said reel during taking up said wire and wherein said detector position adjustment mechanism moves said detector in the traversing direction each one turn of said wire on said reel.

8. A wire take up apparatus as set forth in claim 7, wherein said detector is rotatable about a generally vertical axis normal to the pivotal axis of said arms and further comprising an actuator to urge one of said arms leading in the traversing direction to be engaged against the side of turn of said wire being presently wound on said reel.

9. A wire take up apparatus as set forth in claim 8, wherein said wire raising up detector comprises a rocking angle detecting element to electrically detect the angle at which said arms are rocked about said generally vertical axis by a new turn of said wire on said reel against said actuator, an output signal from said rocking angle detecting element being supplied to said detector position adjustment mechanism to move said detector in the traversing direction at the distance corresponding to one turn of said wire.

10. A wire take up apparatus as set forth in claim 9, wherein said wire raising up detector further comprises a winding layer termination detecting element to electrically detect that said wire nearly reaches either of said reel flanges, an output signal from said winding layer termination detecting element being supplied to said actuator to reverse it.

11. A wire take up apparatus as set forth in claim 6, wherein said wire raising up detector comprises three adjacent arms and two angular-electro converters to electrically detect the angular relative movements of two adjacent arms and the other two adjacent arms of said three arms, respectively.

* * * * *